US010034812B2

(12) United States Patent
Weber et al.

(10) Patent No.: US 10,034,812 B2
(45) **Date of Patent: *Jul. 31, 2018**

(54) BIOMECHANICALLY DERIVED CRUTCH

(71) Applicant: Mobi, LLC, Minneapolis, MN (US)

(72) Inventors: Jeffrey A. Weber, Minneapolis, MN (US); Shawn Monitor, Minneapolis, MN (US); Michael Grider, Minneapolis, MN (US)

(73) Assignee: Mobi, LLC, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/375,731

(22) Filed: Dec. 12, 2016

(65) Prior Publication Data

US 2017/0181918 A1 Jun. 29, 2017

Related U.S. Application Data

(63) Continuation of application No. 13/729,860, filed on Dec. 28, 2012, now Pat. No. 9,517,174, which is a (Continued)

(51) Int. Cl.
*A61H 3/02* (2006.01)

(52) U.S. Cl.
CPC ..... *A61H 3/0277* (2013.01); *A61H 3/02* (2013.01); *A61H 2003/0216* (2013.01); *A61H 2201/1635* (2013.01)

(58) Field of Classification Search
CPC ..... A45B 9/02; A45B 2009/005; A61H 3/02; A61H 3/00; A61H 2201/1635; (Continued)

(56) References Cited

U.S. PATENT DOCUMENTS 1,137,008 A 4/1915 Kindermann
1,241,815 A 10/1917 Blackard
(Continued)

FOREIGN PATENT DOCUMENTS

JP 4006086793 A 3/1994
JP 2000126253 A 5/2000
(Continued)

OTHER PUBLICATIONS

EP Application No. 08727509.5, Communication Pursuant to Article 94(3) EPC, dated Sep. 3, 2014, 5 pages
(Continued)

*Primary Examiner* — Winnie Yip
(74) *Attorney, Agent, or Firm* — Patterson Thuente Pedersen, P.A.

(57) ABSTRACT

A crutch having a first side direction, a second side direction opposite the first side direction, a third side direction perpendicular to the first side direction and a fourth side direction opposite the third side direction, the crutch including an elongate leg having a top end, a top portion, a middle portion, a bottom portion, and a bottom end, wherein the elongate leg extends from a saddle to a foot and has a handle disposed on the middle portion, wherein the saddle extends in an elongate shape between the first side direction and the second side direction, wherein the handle extends in an elongate shape between the first side direction and the second side direction, wherein the elongate leg middle portion is to the third side direction of an axis extending between the leg and the foot, wherein the elongate leg middle portion is to the first side direction of an axis extending between the top end of the elongate leg and the bottom end of the elongate leg; and wherein the handle is cantilevered and has a fixed end and a free end.

16 Claims, 10 Drawing Sheets

Related U.S. Application Data continuation of application No. 13/052,703, filed on Mar. 21, 2011, now Pat. No. 8,342,196, which is a continuation of application No. 12/754,115, filed on Apr. 5, 2010, now Pat. No. 7,926,498, which is a continuation of application No. 11/621,893, filed on Jan. 10, 2007, now Pat. No. 7,717,123.

(58) Field of Classification Search

CPC ..... A61H 3/0277; A61H 2003/006; A61H 2003/0233; A61H 2003/0227; A61H 2003/0238

USPC ..... 135/65, 68–69, 71–74, 76, 82, 86; 482/67–69, 77; 297/411.1–411.2

See application file for complete search history.

(56) References Cited

U.S. PATENT DOCUMENTS 1,652,110 A 12/1927 Fullington
1,673,609 A 6/1928 Weis
2,362,642 A 11/1944 Lamb
2,398,247 A 4/1946 Redcliffe
2,408,604 A 10/1946 Brickson
2,429,409 A 10/1947 Eidman
2,547,265 A 4/1951 Hilgeman
2,552,902 A 5/1951 Miley et al.
2,568,654 A 9/1951 Neptune
2,696,826 A 12/1954 Davies
2,707,478 A 5/1955 Davies
3,174,494 A 3/1965 Maguire, Jr.
3,269,400 A 8/1966 Smith et al.
3,272,210 A 9/1966 Boruvka
3,417,765 A 12/1968 Slater et al.
D223,378 S 4/1972 Austin
3,757,807 A 9/1973 Manzo
3,768,495 A 10/1973 Smith
3,947,140 A 3/1976 Thomas
4,062,372 A 12/1977 Slusher
4,196,742 A 4/1980 Owen
D268,456 S 4/1983 Oleniak et al.
4,493,334 A 1/1985 Semanchik et al.
4,597,589 A 7/1986 Fujii et al.
4,625,743 A 12/1986 Harker
4,630,626 A 12/1986 Urban
4,637,414 A 1/1987 Urban
D288,143 S 2/1987 Scott
4,711,261 A 12/1987 Rosenberg
4,763,680 A 8/1988 Acosta, Sr.
4,775,168 A 10/1988 Dalebout
4,899,771 A 2/1990 Wilkinson
4,941,497 A 7/1990 Prather et al.
4,958,650 A 9/1990 Dale
D318,366 S 7/1991 Goldstein et al.
5,058,923 A 10/1991 Dale
5,085,487 A 2/1992 Weingartner et al.
5,103,850 A 4/1992 Davis
5,197,501 A 3/1993 Ragatz
5,201,334 A 4/1993 Tseng
5,287,870 A 2/1994 Rhodes
5,295,499 A 3/1994 Stutz
5,301,704 A 4/1994 Brown
5,318,058 A 6/1994 Zimmerman
5,328,205 A 7/1994 Bacharach
5,329,954 A 7/1994 Miyoshi
5,331,989 A 7/1994 Stephens
5,336,708 A 8/1994 Chen
5,337,771 A 8/1994 Berges et al.
5,339,850 A 8/1994 Mertz
5,349,977 A 9/1994 Wood
5,409,029 A 4/1995 Davis
5,458,145 A 10/1995 Davis
5,482,070 A 1/1996 Kelly
5,482,072 A 1/1996 Cimino
D369,663 S 5/1996 Gostine
5,564,451 A 10/1996 Hagberg
5,566,700 A 10/1996 Brown
5,571,065 A 11/1996 Buiton
5,575,299 A 11/1996 Bieri
5,606,985 A 3/1997 Battiston et al.
5,633,286 A 5/1997 Chen
D382,104 S 8/1997 Stefanelli et al.
5,671,765 A 9/1997 Hagberg, Jr.
D384,851 S 10/1997 Heginbottom
5,725,005 A 3/1998 Yamasaki et al.
D394,148 S 5/1998 Hosick
5,848,603 A 12/1998 Urban
5,865,180 A 2/1999 Sigfrid
5,954,074 A 9/1999 Mattson
5,964,385 A 10/1999 Simon
6,059,368 A 5/2000 Stumpf et al.
6,070,907 A 6/2000 Bujold et al.
6,085,766 A 7/2000 Geary
6,142,527 A 11/2000 Lenhart
6,164,305 A 12/2000 Herman
6,186,487 B1 2/2001 Kesinger
D443,132 S 6/2001 Jones
6,279,591 B1 8/2001 Obitts
6,286,529 B1 9/2001 Olivera
D449,043 S 10/2001 Chow
6,338,354 B1 1/2002 Alexander
6,378,541 B1 4/2002 Matthews
6,401,738 B1 6/2002 Alexander
6,460,891 B1 10/2002 Jones
D466,749 S 12/2002 O'Quinn
6,491,323 B1 12/2002 Kustritz
6,494,919 B1 12/2002 Matthews
D476,148 S 6/2003 Horton
6,637,773 B1 10/2003 Trinen et al.
D481,531 S 11/2003 Haythornthwaite
6,644,328 B1 11/2003 Lenhart
6,772,778 B2 8/2004 Morosini et al.
6,851,438 B2 2/2005 Battiston
6,938,630 B2 9/2005 Perner
6,959,716 B1 11/2005 Schrader
6,988,745 B2 1/2006 Trinen et al.
D515,802 S 2/2006 Grierson et al.
D516,295 S 3/2006 Davis
7,047,990 B2 5/2006 Zambrano et al.
7,059,674 B2 6/2006 Garland et al.
7,104,271 B2 9/2006 Larson et al.
D531,399 S 11/2006 Olerud
D539,523 S 4/2007 Wu
7,222,633 B1 5/2007 Werner, III
D552,245 S 10/2007 Davis
7,322,612 B2 1/2008 Trinen et al.
7,357,139 B2 4/2008 Bonin, Jr.
7,360,547 B2 4/2008 Carlson
7,383,848 B2 6/2008 Kowsky
7,422,025 B1 9/2008 Waldstreicher et al.
7,434,592 B2 10/2008 Larson et al.
7,445,016 B1 11/2008 Ortiz
7,537,017 B2 5/2009 Baker
D600,002 S 9/2009 Fulkerson
7,591,275 B2 9/2009 Baker
7,621,288 B2 11/2009 Evans
7,654,275 B2 2/2010 Ewell et al.
7,712,478 B2 5/2010 Gibbons et al.
7,712,479 B2 5/2010 Sundarrao
7,717,123 B2 5/2010 Weber et al.
D622,497 S 8/2010 Branton
D625,510 S 10/2010 Muller et al.
7,882,847 B2 2/2011 Coe
7,891,708 B2 2/2011 Panizza
7,896,013 B2 3/2011 Lerner
7,926,498 B2 4/2011 Weber et al.
7,926,499 B2 4/2011 Weber et al.
D644,831 S 9/2011 Smith
D654,682 S 2/2012 White
8,342,196 B2 1/2013 Weber et al.
8,418,706 B2 4/2013 Weber et al.
D688,863 S 9/2013 White
D689,304 S 9/2013 Tang
D691,364 S 10/2013 White

(56) References Cited

U.S. PATENT DOCUMENTS

| | | | |
|---|---|---|---|
| D750,884 | S | 3/2016 | Weber |
| D774,745 | S | 12/2016 | Weber |
| 9,517,174 | B2 | 12/2016 | Weber et al. |
| 2001/0032662 | A1 | 10/2001 | Battiston |
| 2002/0144723 | A1 | 10/2002 | Zulla et al. |
| 2004/0144410 | A1 | 7/2004 | Cheng et al. |
| 2004/0163693 | A1 | 8/2004 | Uemura |
| 2004/0206384 | A1 | 10/2004 | Zambrano et al. |
| 2004/0226593 | A1 | 11/2004 | Robitaille et al. |
| 2004/0250845 | A1 | 12/2004 | Rudin et al. |
| 2005/0076940 | A1 | 4/2005 | Larson et al. |
| 2006/0081280 | A1 | 4/2006 | Fair |
| 2006/0090783 | A1 | 5/2006 | King-Fai |
| 2006/0124163 | A1 | 6/2006 | Tu |
| 2006/0260664 | A1 | 11/2006 | Kowsky |
| 2007/0131264 | A1 | 6/2007 | DeMay et al. |
| 2007/0144567 | A1 | 6/2007 | Haslach, Jr. et al. |
| 2008/0035192 | A1 | 2/2008 | Baker |
| 2008/0053502 | A1 | 3/2008 | Tseng |
| 2008/0163914 | A1 | 7/2008 | Weber et al. |
| 2008/0169011 | A1 | 7/2008 | Ewell et al. |
| 2008/0169635 | A1 | 7/2008 | Panizza |
| 2008/0283103 | A1 | 11/2008 | Jacobs et al. |
| 2008/0314426 | A1 | 12/2008 | Estrada, Jr. |
| 2009/0114257 | A1 | 5/2009 | Sutton |
| 2009/0159106 | A1 | 6/2009 | Schulz et al. |
| 2009/0235966 | A1 | 9/2009 | Birnbaum |
| 2009/0250088 | A1 | 10/2009 | Gibbons et al. |
| 2009/0266392 | A1 | 10/2009 | Campbell |
| 2010/0024857 | A1 | 2/2010 | Larson |
| 2010/0051077 | A1 | 3/2010 | McGann et al. |
| 2010/0071739 | A1 | 3/2010 | Cho |
| 2010/0186790 | A1 | 7/2010 | Weber et al. |
| 2010/0186791 | A1 | 7/2010 | Weber et al. |
| 2010/0200030 | A1 | 8/2010 | Yefimov |
| 2010/0206348 | A1 | 8/2010 | Markou |
| 2010/0229903 | A1 | 9/2010 | Ozuna et al. |
| 2010/0269872 | A1 | 10/2010 | Tharp |
| 2010/0288319 | A1 | 11/2010 | Luo |
| 2011/0005559 | A1 | 1/2011 | Daily |
| 2011/0073144 | A1 | 3/2011 | Goldberg et al. |
| 2011/0073145 | A1 | 3/2011 | Goldberg et al. |
| 2011/0108075 | A1 | 5/2011 | Weber |
| 2011/0168218 | A1 | 7/2011 | Weber et al. |
| 2012/0318313 | A1 | 12/2012 | Dickerson, II |
| 2013/0098412 | A1 | 4/2013 | Weber |
| 2013/0180558 | A1 | 7/2013 | Weber et al. |
| 2013/0199586 | A1 | 8/2013 | Van Den Driesche |
| 2014/0326285 | A1 | 11/2014 | Cappiello Rodriguez et al. |

FOREIGN PATENT DOCUMENTS

| | | | |
|---|---|---|---|
| JP | 2003111807 | A | 4/2003 |
| JP | 2004173916 | A | 6/2004 |
| WO | WO 82/02490 | A1 | 8/1982 |
| WO | WO 2004/047706 | A2 | 6/2004 |
| WO | WO 2008/010346 | A1 | 1/2008 |
| WO | WO 2008/086459 | A2 | 7/2008 |
| WO | WO 2010/017566 | A2 | 2/2010 |
| WO | WO 2011/060178 | A1 | 5/2011 |
| WO | WO 2013/059689 | A2 | 4/2013 |

OTHER PUBLICATIONS

EP Application No. 08727509.5, Communication Pursuant to Article 94(3) EPC, dated Jun. 5, 2012, 6 pages.
AU Application No. 2008204869, First Examination Report, dated Jul. 10, 2012, 5 pages.
CN Application No. 20080006045.2, Second Office Action, dated Aug. 15, 2011, 8 pages.
CN Application No. 200880006045.2, First Office Action, dated Dec. 2, 2010, 15 pages.
CN Application No. 200880006045.2, Response to Second Office Action, dated Oct. 31, 2011, 17 pages.
EP Application No. 08727509.5, Response to Communication Pursuant to Article 94(3), dated Dec. 5, 2012, 26 pages.
PCT Application No. PCT/US2008/050707, Written Opinion & Search Report, dated Sep. 3, 2008, 12 pages.
PCT Application No. PCT/US2010/056393, Written Opinion & Search Report, dated May 3, 2011, 13 pages.
PCT Application No. PCT/US2012/061153, Written Opinion & Search Report, dated Sep. 16, 2013, 8 pages.
Application and File History for U.S. Appl. No. 11/621,893, filed Jan. 10, 2007, now U.S. Pat. No. 7,717,123. Inventors Weber et al.
Application and File History for U.S. Appl. No. 12/754,115, filed Apr. 5, 2010, now U.S. Pat. No. 7,926,499. Inventors Weber et al.
Application and File History for U.S. Appl. No. 12/754,136, filed Apr. 5, 2010, now U.S. Pat. No. 7,926,499. Inventors Weber et al.
Application and File History for U.S. Appl. No. 13/052,703, filed Mar. 21, 2011, now U.S. Pat. No. 8,342,196. Inventors Weber et al.
Application and File History for U.S. Appl. No. 13/729,860, filed Dec. 28, 2012, now U.S. Pat. No. 9,517,174. Inventors Weber et al.
Application and File History for U.S. Appl. No. 12/944,330, filed Nov. 11, 2010, now U.S. Pat. No. 8,418,706. Inventor Weber.
Application and File History for U.S. Appl. No. 13/656,335, filed Oct. 19, 2012. Inventor Weber.
Application and File History for U.S. Appl. No. 29/477,334, filed Dec. 20, 2013, now U.S. Pat. No. D,750,884. Inventor Weber.
Application and File History for U.S. Appl. No. 29/477,340, filed Dec. 20, 2013, now U.S. Pat. No. D,774,745. Inventor Weber.
IN Application No. 2855/KOLNP/2009, First Examination Report, dated Mar. 2017, 8 pages.

BIOMECHANICALLY DERIVED CRUTCH

This application is a continuation of U.S. application Ser. No. 13/729,860 (now U.S. Pat. No. 9,517,174), filed Dec. 28, 2012, which in turn is a continuation of U.S. application Ser. No. 13/052,703 (now U.S. Pat. No. 8,342,196), filed Mar. 21, 2011, which is a continuation of U.S. application Ser. No. 12/754,115 (now U.S. Pat. No. 7,926,498), flied Apr. 5, 2010, which is a continuation of U.S. application Ser. No. 11/621,893 (now U.S. Pat. No. 7,717,123), filed Jan. 10, 2007, the content of all of which is herein incorporated by reference in its entirety.

FIELD

This invention pertains to medical devices for ambulatory assistance such as crutches and more particularly to improvements to the ergonomics and ease-of-use of crutches.

BACKGROUND

Crutches are used by millions of people each year recovering from lower-limb ailments such as broken bones, knee injuries and sprained ankles. One of the most common crutches in use today is some variation of that shown in FIGS. 1A and 1B. This crutch 2 has a saddle 4 generally covered by a foam rubber pad, which is hot, sticky and causes under-arm skin abrasion. The crutch has a narrow transverse handle 6 that puts undo strain on the wrist by forcing it into a collapsed position. The crutch handle is a narrow tube disposed horizontally in a narrow opening and this creates soreness in the hand and wrist. The crutch foot 8 generally widens at the bottom and so catches under doors and ledges, making use more difficult. When used, the crutches angle out from the user, creating a wide stance that makes it more difficult to move through confined spaces such as crowds, doorways or hallways, as illustrated in FIG. 2. This crutch typically has a low degree of adjustability, which requires many sizes to be stocked to accommodate the variety of sizes found in the population. For example, typical crutches come in three sizes, fitting individuals with heights of 6'6"-5'10", 5'9" to 5'1" and 5'2" to 4'6".

There is thus a continuing need for new and improved crutch designs.

SUMMARY

One embodiment pertains to an arcuate crutch having a mesh saddle disposed on a curved leg. The saddle includes a resilient mesh web disposed over a frame pivotably attached to the leg. The frame may flex with the weight of the user to spread outwards and provide greater contact area with the user and to help the saddle stay with the user during use. The leg may be curved outwardly to accommodate the shape of the user while maintaining a narrow footprint and curved to the front to properly position the handle. The leg may be adjustable and may include two or three sections which slide with respect to each other to accommodate users of various heights. The handle may be fixed to the leg and may extend back from the frame at an upward and outward angle to provide a natural and ergonomic position for the hand. The foot may include an oval, curved tread pattern and may flex to provide cushioning and orientation.

Another embodiment pertains to a crutch leg that has a curved shape to permit the user to have a narrow stance when using crutches. The crutch leg curves outwardly at the middle to accommodate the shape of the user and inwardly at the bottom to keep the overall stance narrow. The crutch leg may also curve to the front to provide a position for the crutch handle that is along an axis of the crutch from saddle to foot. The crutch leg may be smoothly curved or may include straight sections joined at angles.

Another embodiment pertains to a crutch saddle that incorporates a resilient mesh disposed on a frame. The mesh stretches over the frame to provide a contact surface. The mesh deforms somewhat while still provide support. The frame may also deform as the user applies weight to the crutch.

Another embodiment pertains to crutch foot that has a resilient bottom surface that is curved from front to back and flat laterally. The resilient bottom surface is connected to an ankle that may bend slightly as the user applies weight to orient the foot to provide greater traction.

Another embodiment pertains to a crutch foot that tapers smoothly from the crutch leg to a dimpled bottom surface without lips.

The above summary of some embodiments is not intended to describe each disclosed embodiment or every implementation of the present invention. The figures and detailed description which follow more particularly exemplify these embodiments.

BRIEF DESCRIPTION OF DRAWINGS

The invention may be more completely understood in consideration of the following detailed description of various embodiments of the invention in connection with the accompanying drawings in which.

DETAILED DESCRIPTION OF SELECT EMBODIMENTS

Figure 1B:
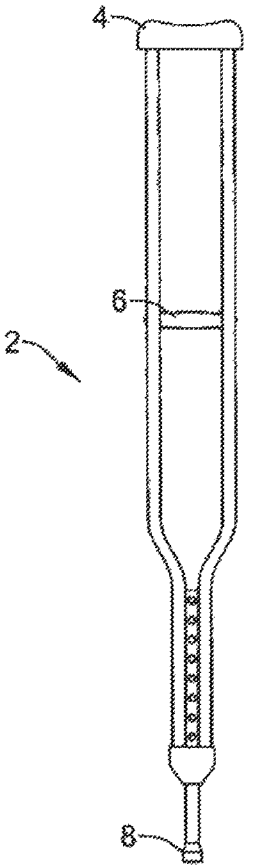
Figure 1B Prior Art
FIG. 1B is a side view of the prior art crutch of FIG. 1.
Figure 1A:
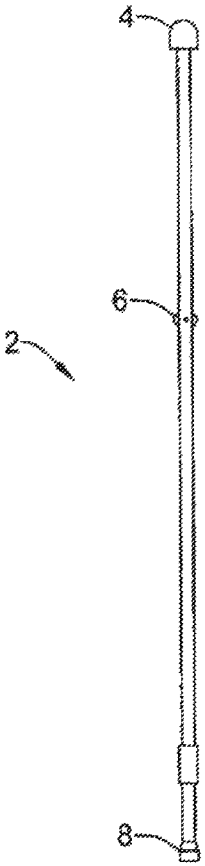
Figure 1A Prior Art
FIG. 1A is a front view of a prior art crutch.
Figure 2:
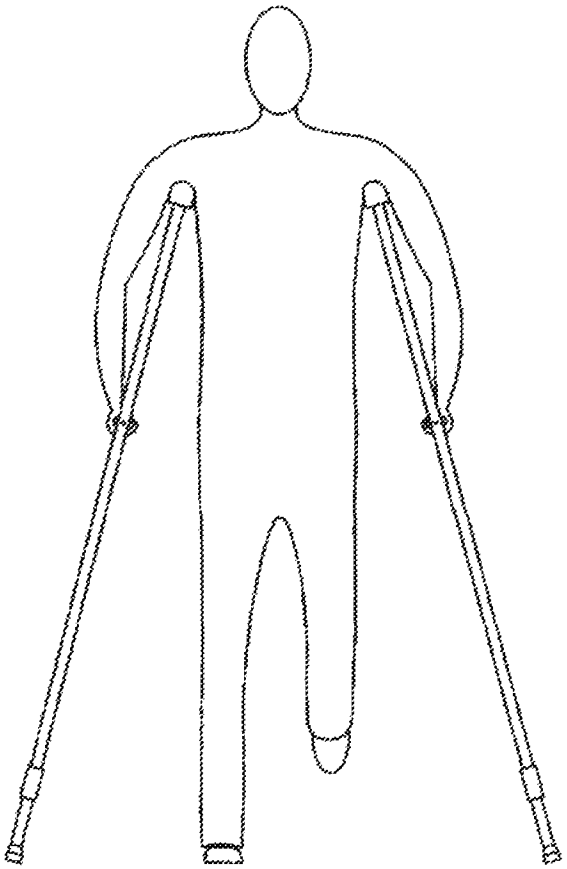
Figure 2 Prior Art
FIG. 2 is a front view illustrating a pair of the prior art crutches in use.
Figure 3B:
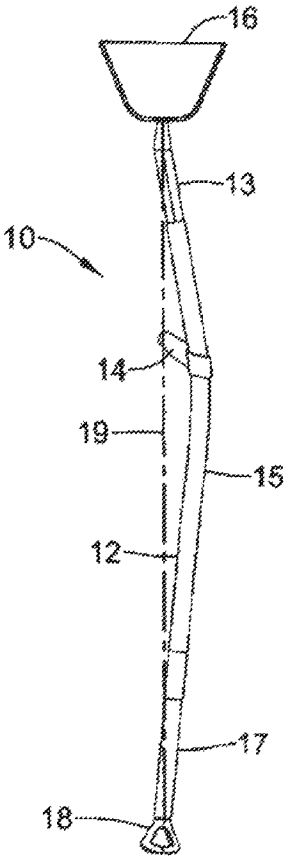
FIG. 3B is a side view of the crutch 10.
Figure 3A:
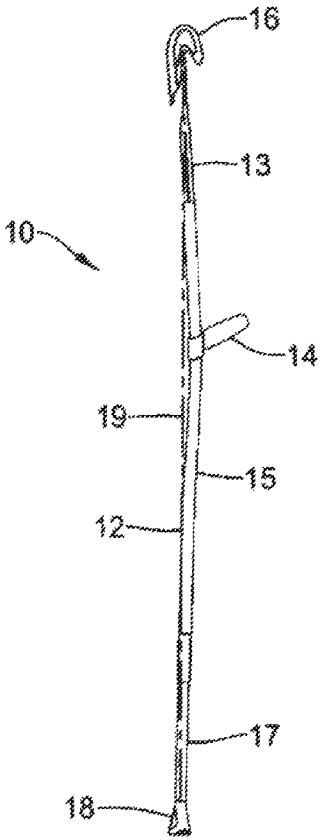
FIG. 3A is a front view of an example crutch 10.

An example crutch 10, shown in front and side views in FIGS. 3A and 3B respectively, includes an elongate leg 12 having a handle 14 disposed thereon and has a saddle 16 at the top and a foot 18 at the bottom. Crutch 10 is a handed crutch and is configured for optimal use with a particular hand and side of the body. The particular crutch 10 shown is a left-handed crutch, but references to crutch 10 should not be understood as limited to a crutch of a particular handedness. A right-handed crutch is omitted for the sake of simplicity, but it should be understood that the discussion herein is applicable to right-handed crutches, which are contemplated and which are in a mirror image of their left-handed counterparts. Further, it is anticipated that the crutches disclosed herein may and often will be packaged in a set including a left-handed crutch and a right-handed crutch. Still further, some embodiments and features of the present invention are not limited to handed crutch and may be used in conjunction with crutches or other devices that are equally suited to use with either hand.

Figure 4B:
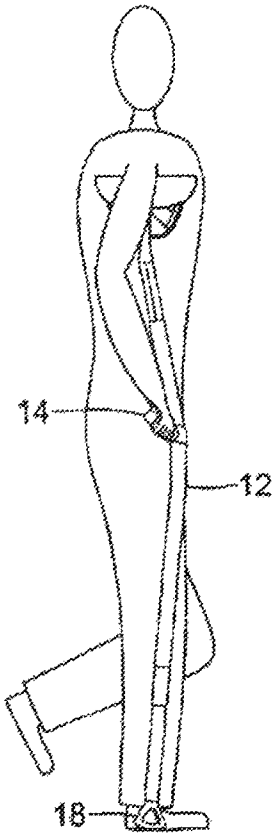
FIG. 4B is a side view illustrating a pair of the crutches 10 in use.
Figure 4A:
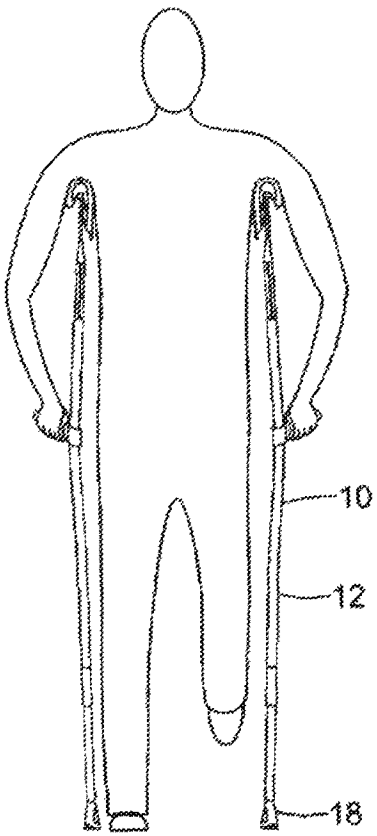
FIG. 4A is a front view illustrating a pair of the crutches 10 in use.

The elongate leg 12 may be understood better with reference to FIGS. 4A and 4B, which are front and side views showing a pair of crutches in use as well as to FIGS. 3A and 3B. Leg 12 may be shaped to accommodate a narrower stance width, which eases mobility in crowded areas and cramped areas. In the embodiment shown, leg 12 arcs outwardly to the side to accommodate the hip area and then arcs back in to narrow the stance. In other words, the middle portion 15 of leg 12 is to one side of an axis 19 extending between the top end of the leg and the bottom end of the leg. Further and less obvious, this axis between the top end of the leg and the bottom end of the leg is not perfectly vertical but is at a small angle such that the bottom end of the leg, connected to the foot, is further out from a vertical axis running through the center of the user than the top end of the leg, which is connected to the saddle. The bottom end of the leg is not as far from this central axis of the user as the middle portion of the leg. In this manner, the crutch bows to one side to accommodate the shape of a body while creating a narrow stance.

As can be seen in FIGS. 3B and 4B, the crutch 10 may also arc to the front (which is a feature distinct from the side arc discussed above). This frontal arc accommodates the handle so that the hand of the user is positioned along an axis between the saddle and the foot. This is a natural position for the hand of the user and creates balance to reduce effort by the user in keeping the crutch from shifting forward or backward with respect to the shoulder and reduce shear stress on the skin in contact with the saddle. The contact could of course be direct surface-to-surface contact or it could be indirect contact, with one or more layers of clothing or other articles therebetween.

Leg 12 has a middle section, an upper section and a lower section. The upper section and lower section are both adjustable with respect to the middle section to fit the crutch to a particular user. The upper section may be adjusted with respect to the middle section to fit the crutch to an arm of a particular length and the lower section may be subsequently adjusted to fit the crutch to the height of a user. The versatility of the crutch is such that a single adjustable crutch can accommodate people with heights of 5'0"-6'6" and a smaller adjustable crutch can accommodate people with heights of 4'0"-5'0". In the particular embodiment of crutch 10, the upper section and the lower section are telescopically inserted into the middle section. The cross-sectional shape of these sections may be circular or optionally may be oval, oblong or other non-circular shape to maintain the orientation of these sections with respect to each other. Once the sections of the crutch leg are adjusted with respect to each other, they may be fixed in any suitable manner. For example, one embodiment provides continuous adjustability by use of collets where tapered flanges fixed to one section are clamped to another section by the operation of a threaded collar. Another embodiment may provide discrete adjustment by providing a spring loaded pin in one section that can lock into a hole in the corresponding section. When the pin is in a hole, relative movement of the two sections is prevented. The two sections may be adjusted by depressing the pin and sliding one section with respect to another. Another embodiment that provides discrete adjustment has sets of holes in both sections through which a bolt can be inserted and secured with a nut or a wing nut. These or any other suitable adjustment and fastening system may be used. The leg 12 may further include one or more fittings such as plastic bushings 17 or the like that serve to secure the sections of the leg with respect to each other to prevent rattling and provide a solid one-piece feel.

In the embodiment of crutch 10, handle 14 is fixed to leg 12 such that no adjustment is possible. Handle 14 has an end fixed to the leg and extends to the rear from this fixed end at a slight upward angle and also extends outwardly away from the user. The handle position thus enables the user to grip the crutch handle while keeping the hand and the wrist at a more natural and ergonomic position. The handle may be molded to have a profile that conforms to a gripping hand or may have a more traditional barrel or tube shape or other suitable shape. The handle may be made from a firm non-slip material such as a rubber coated plastic or may include a softer foam sheath or may be made from another suitable material.

Figure 5B:
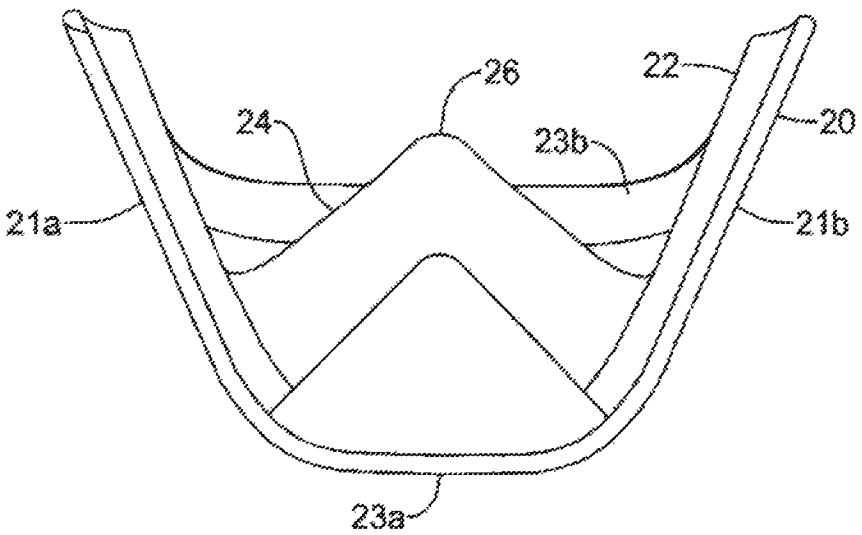
FIG. 5B is a side view of the saddle frame.
Figure 5A:
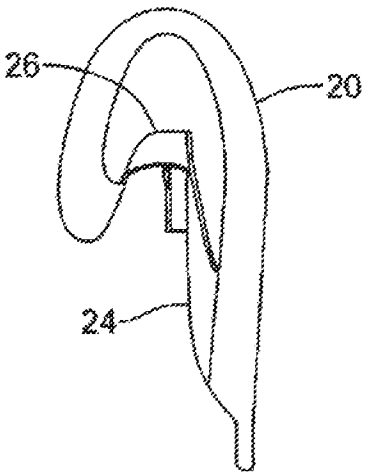
FIG. 5A is a front view of an example saddle frame.

A saddle 16 is attached at the top of the crutch, and generally includes a membrane 29 disposed on a frame 20. A frame 20 may be seen in FIGS. 5A and 5B, which are front and side views of the frame 20, respectively. The saddle has an outer surface which supports the user and the extent of this outer surface is defined by the frame. Frame 20 includes two frame members 21A and 21B on opposite sides, which are used to support the membrane. Frame members 21A and 21B may be joined together by frame members 23A and 23B to provide a smooth outer perimeter for the saddle. Frame members 23A and 23B may also provide strength to the frame and support for the membrane. The frame members are supported by mounting member 24, which includes a centrally located joint 26. Mounting member 24 is thin in one direction and wide in a second direction, which gives the frame resilience as described below as well as stiffness to support the membrane. The saddle may also include an inner lip 22 that helps to support the membrane when the saddle is loaded by the user. The shape of the saddle generally includes two lobes that are connected by a curved upper surface. In one embodiment, the inner lobe (i.e. the lobe that rests against the torso of the user) is larger than the outer lobe (i.e. the lobe that rests against the arm of the user). In another embodiment, the inner lobe and the outer lobe may be the same size.

Figure 6:
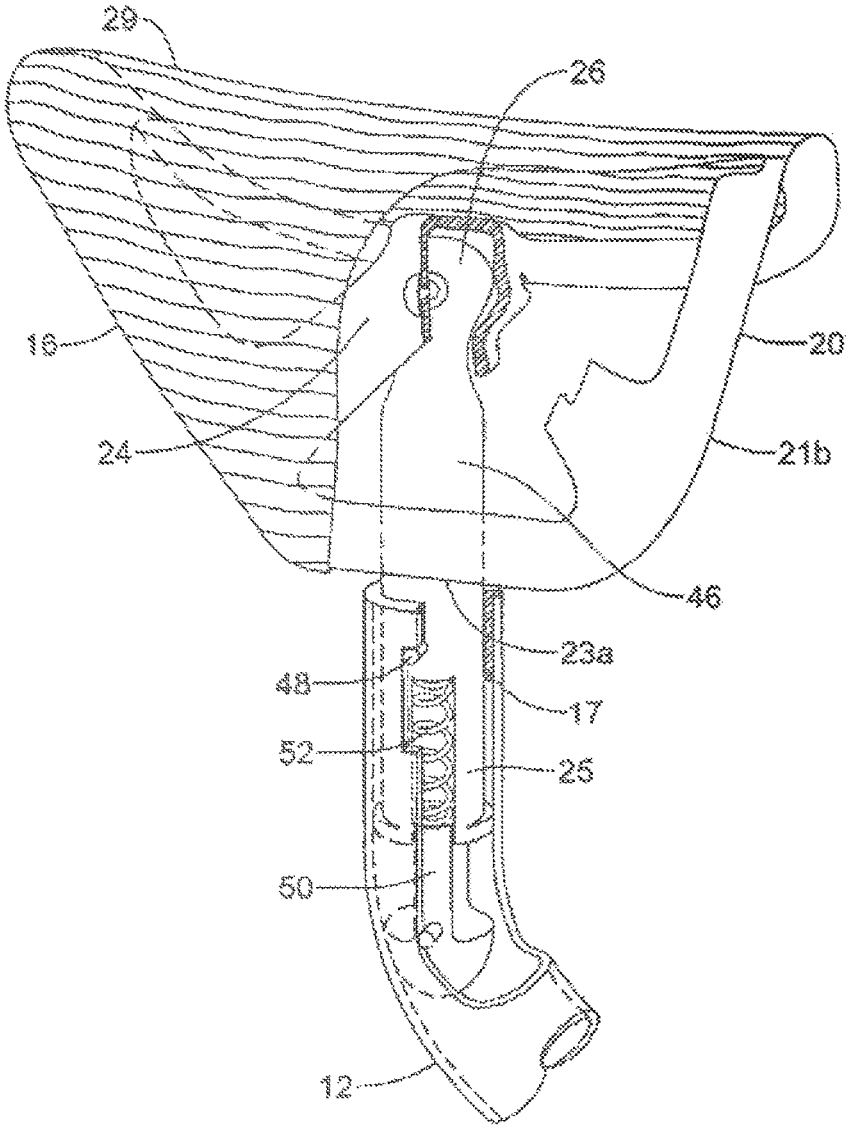
FIG. 6 is a cutaway view of the top portion of an example crutch.
Figure 8:
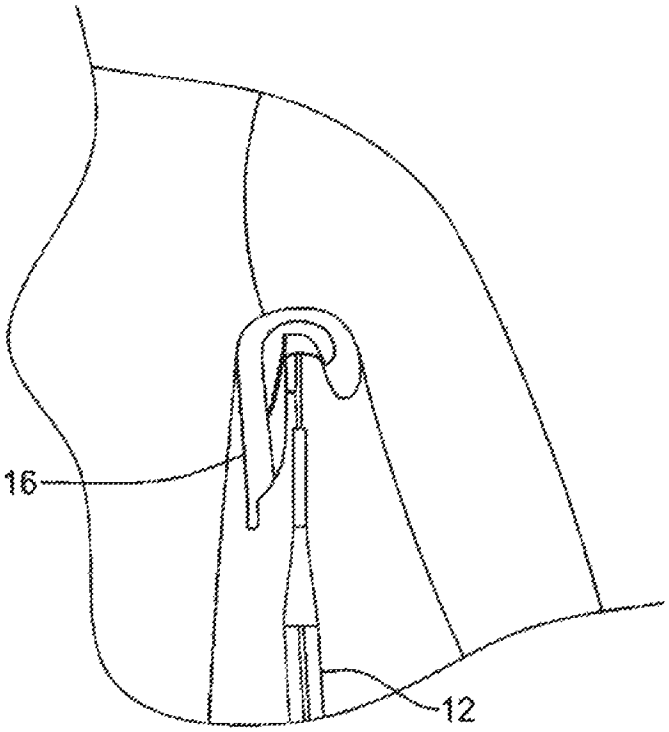
FIG. 8 is a front view of the top portion of an example crutch in use.
Figure 7:
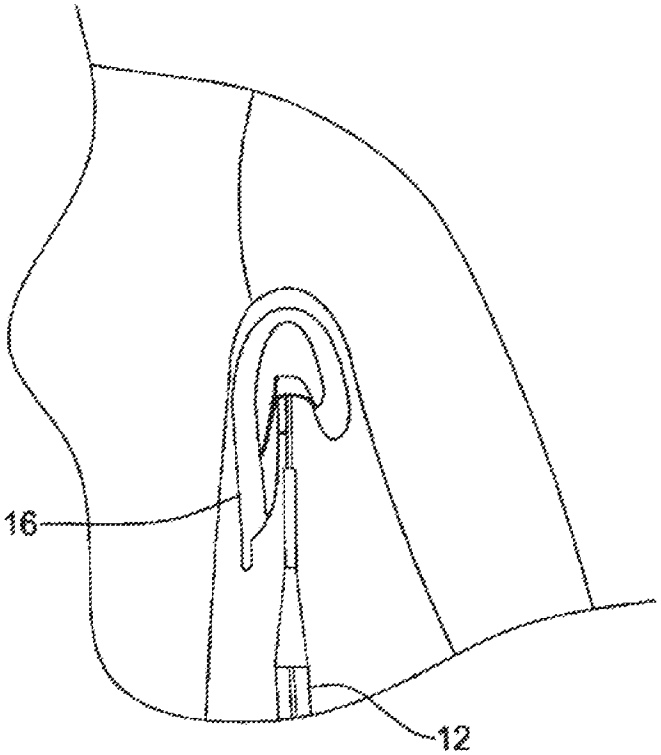
FIG. 7 is a front view of the top portion of an example crutch in position.

The saddle is designed to be position in the armpit of a user to help support the user and move with the user during operation by staying in the armpit while the rest of the crutch is moved back and forth with respect to the user's body. The saddle has at least two mechanisms by which this is accomplished. First, the saddle is pivotably attached to the leg through joint 26, which joint can be best seen in FIG. 6. In one embodiment, joint 26 provides one degree of rotational freedom oriented so that the leg moves back and forth with respect to the saddle along a path parallel to that of the user. In another embodiment, the joint allows the leg to move along an outwardly arced path. The joint may include a pin on which the leg rotates with respect to the saddle, may be a ball-and-socket type joint or may have another suitable configuration. Second, the saddle frame, mounting member, and frame members may be made from resilient materials that deflect as the user loads weight onto the saddle, as illustrated in FIGS. 7 and 8. FIG. 7 illustrates the crutch between the arm and body of a user before the user 10 has placed weight on the crutch. As the user loads weight onto the crutch through the saddle, the saddle is able to widen to provide greater surface contact with the user and thus to reduce pressure against the user's armpit as shown in FIG. 8. The saddle also conforms to the shape of the user. For example, as the user lifts weight off the crutch, the saddle will tend to rebound towards the FIG. 7 shape, keeping contact with the user through most of this process. Thus the saddle can move with the user as the user shifts weight from one crutch to the other.

Other mechanisms to ensure that the saddle stays with the user may be included. For example, a shock absorber-type spring mechanism 25 may be mounted between the upper section of the leg and the frame as illustrated in FIG. 6. The spring mechanism 25 includes an upper piece 46 having an upper end mounted in joint 26. The upper piece 46 is slidably disposed in the leg 12 and may include a pin-and-slot mechanism 48 to limit the extent of the travel of this piece relative to the leg. A lower piece 50 is fixed within the leg and spring 52 is captured between the upper piece and the lower piece and provides the shock-absorbing force. In one embodiment, the spring 52 is slightly compressed by the spring mechanism even with no load on the crutch to provide a more solid crutch feel and reduced noise. Of course, spring mechanism 25 is illustrative and not limiting, and other shock-absorbing mechanisms may be used in alternate embodiments.

The saddle 16 includes a membrane 19 fixed across an opening defined by the frame 20. The membrane may be a stretched woven mesh held in tension by being fixed to the frame. An example of a membrane fixed to a frame and the process for doing so is described in publications such as U.S. Pat. No. 6,059,368 to Stumpf et al. entitled "OFFICE CHAIR," which is incorporated herein by reference. Other suitable membranes including solid sheets of polymer, sheets of polymer with holes formed therein, and spun and woven fabrics may be used. The membrane is attached to the frame to create the upper surface of the saddle. The membrane is deflectable and resilient such that it conforms to the user and may spread out the force applied to the saddle surface area. The membrane is mounted on the frame in such a way as to provide support to the user even when the frame is not directly under the membrane.

Figure 9B:
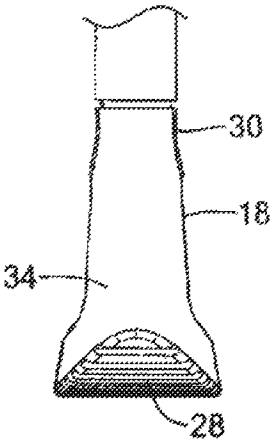
FIG. 9B is a front view of the bottom portion of the example crutch.
Figure 9C:
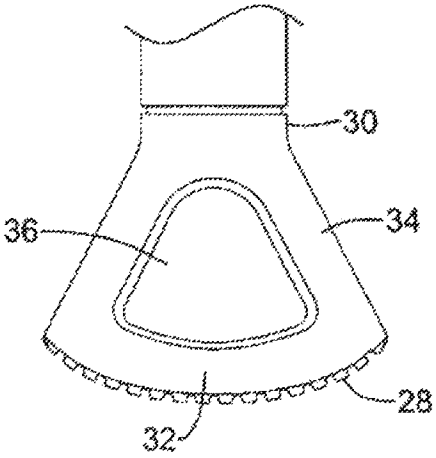
FIG. 9C is a side view of the bottom portion of an example crutch.
Figure 9A:
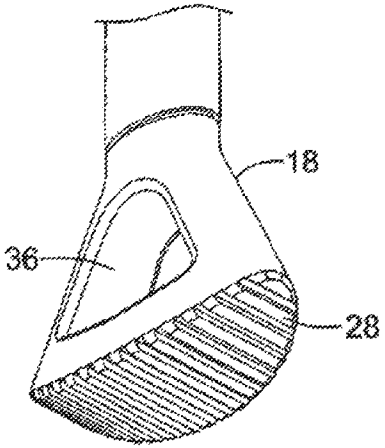
FIG. 9A is an orthogonal view of the bottom portion of an example crutch.

FIGS. 9A, 9B and 9C are, respectively, orthogonal, front and side views of foot 18. Foot 18 has a bottom tread 28 that has a curved oval shape and a tread pattern of grooves that are parallel to the path of the user. The tread pattern is disposed on a resilient section 32 that is attached to the ankle 30 of the foot by risers 34. The resilient section 32 can flex as the user applies weight to the crutch, which increases the contact area with the floor as the greatest weight is applied to the crutch and gives the crutch a more comfortable feel. Ankle 30 may also flex as weight is applied and may have a total range of motion of 20 degrees, 15 degrees or 10 degrees off true. Thus if the crutch is held at an angle, the foot can orient as weight is applied to provide greater grip with the floor. Section 32 and risers 34 define an opening 36 which may be used to hang the crutches, if desired.

Of course, other variations are possible. For example, the foot bottom tread 28 may have other shapes and other tread patterns. The bottom tread may have angular sections rather than a smooth curve or may have a rectangular or polygonal shape. The bottom tread may be curved laterally as well as from front to back. Further, any tread pattern may be suitable. For example, tread patterns such as those found on the bottom of tennis shoes may be suitable. The foot bottom section may be made rigid rather than resilient and the material of the tread may be made of soft material or may have a cushioned backing. Further, the ankle may be set at an angle to the crutch rather than straight. Preferably this would be the angle that would make the foot upright when the crutch was in normal use. The ankle angle may be adjustable to provide for different users and the ankle may be rigid rather than flexible. An embodiment is also contemplate without an opening 36.

Figure 10:
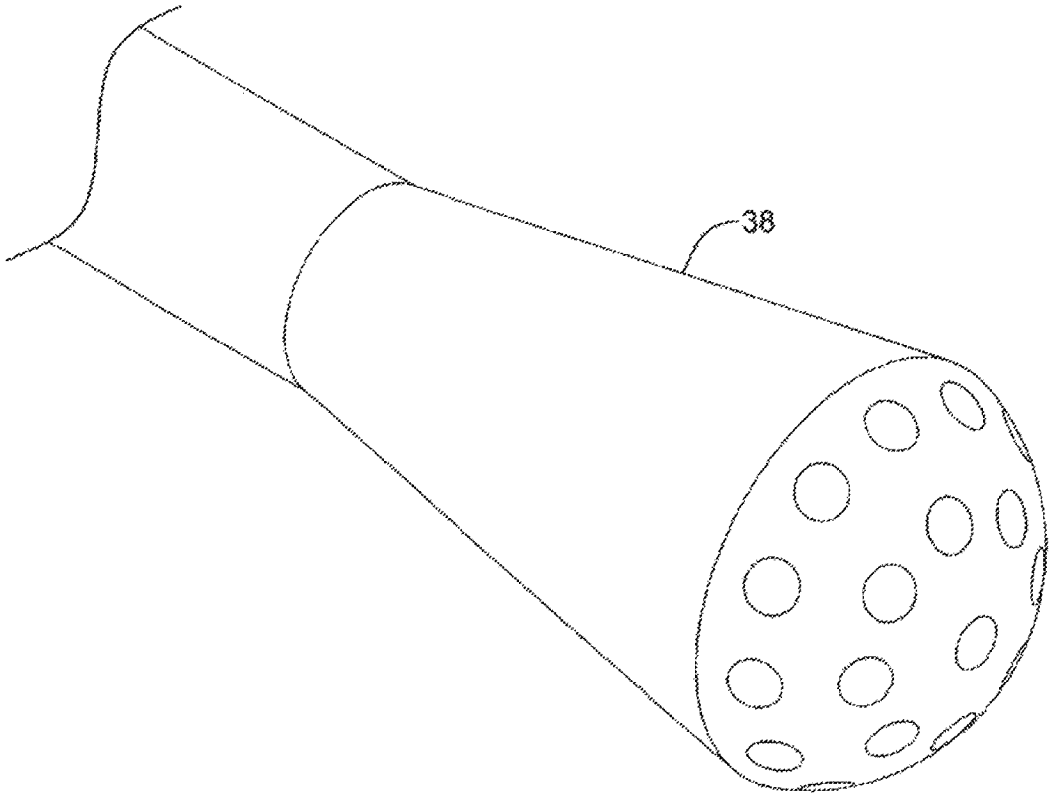
FIG. 10 is an orthogonal view of the bottom portion of an example crutch.

An orthogonal view of an alternate foot 38 is shown in FIG. 10. Foot 38 has a smooth taper from the crutch leg at a relatively small angle. The foot may taper, for example, at 5 degrees, 8 degrees, 12 degrees, 15 degrees or other suitable angle. The end of the foot is round and has a dimpled surface, although other tread patterns are contemplated. The foot preferably is attached to the leg without a lip and continues to its end likewise without a lip. Such an arrangement provides a compact foot that does not get stuck under doors or the like.

Figure 11:
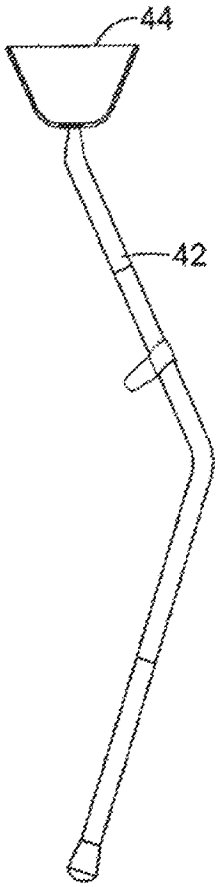
FIG. 11 is a side view of an example crutch.

The example crutch 10 has been described in some detail. While some variations and alternative embodiments have been described above, still other are contemplated. For example, an alternative leg may be used. One alternative leg 42 shown in FIG. 11 includes straight sections joined at an angle to one another while. Leg 42 can be angled to one side and angled to the front to accommodate the shape of the user and the position of the handle as described above. Other embodiments may incorporate both straight and arced sections or may incorporate differently shaped section such as C-shaped sections and still retain the features described above. Still other embodiments may arc or angle to the rear rather than to the front or may include two elongate members with the handle disposed therebetween. Thus the features of the leg shape are not limited to the specific embodiment described.

Another embodiment of a crutch includes an adjustable handle which can be repositioned higher or lower on a crutch leg section. One version of this embodiment may include only two crutch sections, which would permit a user to adjust the height of the crutch and the position of the handle. In another alternative, the handle could extend straight back from the leg rather than outwardly as described above.

Alternatives to the saddle are also contemplated. One alternative saddle 44 is fixed to the leg rather than pivotably attached to it. The saddle frame may be rigid rather than resilient. Thus for example, an embodiment of the invention may have a saddle having a resilient mesh disposed in a frame, where the saddle is rigidly attached to an angular leg.

It can thus be appreciated that the invention is not limited to those embodiments set forth in the foregoing description. It will be appreciated, however, that this disclosure is, in many respects, only illustrative. Changes may be made in details, particularly in matters of shape, size, and arrangement of parts without exceeding the scope of the invention. None of the description in the present application should be read as implying that any particular element, step, or function is an essential element which must be included in the claim scope. Moreover, none of these claims are intended to invoke 35 U.S.C. § 112, ¶6 unless the exact words "means for" are followed by a participle. The invention's scope is, of course, defined in the language in which the appended claims are expressed.

What is claimed is:

1. A crutch having a first side direction generally parallel to a walking direction of a user, a second side direction opposite the first side direction, a third side direction perpendicular to the first side direction and a fourth side direction opposite the third side direction, comprising:

a saddle, extending in an elongate shape between the first side direction and the second side direction, the saddle including— a frame having a support membrane disposed on the frame, the frame and the support membrane providing:

an inner lobe configured to rest against a torso of the user during use, an outer lobe configured to rest against an arm of the user during use, and a top portion connecting the inner lobe and the outer lobe and forming a U-shaped channel having an curved upper surface configured to fit within an armpit of the user with the U-shaped channel open along at least a portion of a downward facing side;

a pivoting joint attached to the frame; and a spring mechanism having an upper portion attached to the pivoting joint such that the joint is configured to allow the spring mechanism to move with respect to the frame along an arced path; and an elongate leg removably attached to the spring mechanism of the saddle at a top end of the elongate leg, the elongate leg extending downward from the saddle toward a bottom end of the elongate leg during use;

wherein the saddle remains generally stationary in the armpit of the user and the elongate leg pivots in response to the user manipulating the crutch in the walking direction.

2. The crutch of claim 1, wherein the joint includes a pin on which the elongate leg pivots in a direction generally parallel to the first side direction.

3. The crutch of claim 1, wherein the joint is a ball-and-socket joint enabling the elongate leg to pivot along the arced path generally parallel to the first side direction extending laterally away from the user in the third side direction or fourth side direction at a central portion of the arced path.

4. The crutch of claim 1 wherein the frame and the support member comprises a resilient mat such that the frame and the support member can expand in the third side direction and fourth side direction and contract vertically under the weight of the user.

5. The crutch of claim 1, wherein the spring mechanism includes a spring that is at least partially compressed by the spring mechanism regardless of a load on the crutch.

6. The crutch of claim 5, wherein the elongate leg further comprises, a vertical slot, the vertical slot having a top end; and the spring mechanism further comprises a pin arranged to protrude at least partially into the vertical slot; and wherein the spring biases the pin toward the top end of the vertical slot.

7. The crutch of claim 1, further comprising handle including a fixed end attached to the elongate leg and a free end extending away from the elongate leg; and wherein the handle is cantilevered up such that when an axis extending between the top end of the elongate leg and the bottom end of the elongate leg is vertical, the free end of the handle is higher than the fixed end of the handle.

8. The crotch of claim 7, wherein the handle is repositionable along a middle portion of the elongate leg.

9. A crutch having a front side facing in a walking direction of a user during use, aback side opposite the front side, an inner side facing toward the torso of the user, and an outer side opposite the inner side, the crutch comprising:

a saddle extending in an elongate shape along an axis from the front side to the back side, the saddle including— a frame having a support membrane disposed on the frame, the frame and the support membrane providing:

an inner lobe configured to rest against a torso of the user during use, an outer lobe configured to rest against an arm of the user during use, and a top portion connecting the inner lobe and the outer lobe and forming a U-shaped channel having an curved upper surface configured to fit within an armpit of the user with the U-shaped channel open along at least a portion of a downward facing side;

a pivoting joint attached to the frame; and a spring mechanism having an upper portion attached to the pivoting joint such that the pivoting joint is configured to allow the spring mechanism to move with respect to the frame along an arced path; and an elongate leg removably attached to the spring mechanism of the saddle at a top end of the elongate leg, the elongate leg extending downward from the saddle toward a bottom end of the elongate leg during use; and a foot disposed at the bottom end of the elongate leg;

wherein the saddle remains generally stationary in the armpit of the user and the elongate leg pivots in response to the user manipulating the crutch in the walking direction.

10. The crutch of claim 9 wherein the joint includes a pin on which the elongate leg pivots along a path generally parallel to the path between the front side and the back side during use.

11. The crutch of claim 9, wherein the joint is a hall-and-socket joint enabling the elongate leg to pivot along the arced path during use, at least a portion of the arced path extending in the direction of the outer side.

12. The crutch of claim 9 wherein the frame member comprises a resilient material, such that the frame member can widen along an axis from the front side to the back side and contract vertically under the weight of the user.

13. The crutch of claim 9, wherein:

the spring is at least partially compressed by the spring mechanism regardless of a load on the crutch;

the elongate leg further comprises a vertical slot, the vertical slot having a top end;

the spring mechanism further comprises a pin arranged to protrude at least partially into the vertical slot; and wherein the spring biases the pin toward the top end of the vertical slot.

14. The crutch of claim 9, further comprising a handle including a fixed end attached to the elongate leg and a free end extending, away from the elongate leg; and wherein the handle is cantilevered up such that when an axis extending between the top end of the elongate leg and the bottom end of the elongate leg, is vertical, the free end of the handle is higher than the fixed end of the handle.

15. The crutch of claim 14, wherein the handle is repositionable along a middle portion of the elongate leg.

16. A method of use of a crutch by a user having a front side and a back side, the crutch including a saddle, an elongate leg, and a handle; the saddle including a frame having a support membrane disposed on the frame, the frame and the support membrane providing: an inner lobe, an outer lobe, and a curved top portion connecting the inner lobe and the outer lobe and forming a U-shaped channel open along at least a portion of a downward facing side, a pivoting joint attached to the frame; and a spring mechanism having an upper portion attached to the pivoting joint such that the pivoting joint is configured to allow the spring mechanism to move with respect to the frame along an arced path; the elongate leg removably attached to the spring mechanism of the saddle at a top end of the elongate leg, the elongate leg extending downward from the saddle toward a bottom end of the elongate leg during use; and the handle operably coupled to the elongate leg at a point between the top end and the bottom end; the method comprising:

arranging the saddle in an armpit of the user, such that— the saddle extends an in elongate shape along an axis between the front side and the back side, the inner lobe rests against the torso of the user, and the outer lobe rests against the arm of the user;

grasping the handle with the hand of the user con the same side as the armpit;

stepping forward with the foot of the user opposite the armpit while transferring at least a portion of the weight of the user to the crutch via the saddle;

transferring at least a portion at the weight of the user to the that while pivoting the elongate leg between the back side and the front side;

such that the saddle remains generally stationary in the armpit of the user as the user steps forward.

* * * * *